US005422650A

United States Patent [19]

Hill

[11] Patent Number: 5,422,650

[45] Date of Patent: Jun. 6, 1995

[54] LOOP ANTENNA WITH SERIES RESONANT CIRCUIT AND PARALLEL REACTANCE PROVIDING DUAL RESONANT FREQUENCIES

[75] Inventor: Roger Hill, Smallfield, England

[73] Assignee: U.S. Philips Corporation, New York, N.Y.

[21] Appl. No.: 113,536

[22] Filed: Aug. 27, 1993

[30] Foreign Application Priority Data

Aug. 28, 1992 [GB] United Kingdom ..... 9218285
Aug. 28, 1992 [GB] United Kingdom ..... 9218286

[51] Int. Cl.[6] ..... H01Q 7/00; H01Q 5/00

[52] U.S. Cl. ..... 343/713; 343/744; 343/748

[58] Field of Search ..... 343/744, 722, 741, 713, 343/743, 748, 848, 866; H01Q 11/12, 1/32, 5/00, 7/00

[56] References Cited

U.S. PATENT DOCUMENTS

| | | | |
|---|---|---|---|
| 2,650,303 | 8/1953 | Schlesinger | 343/74 |
| 3,599,214 | 8/1971 | Altmayer | 343/722 |
| 3,623,110 | 11/1971 | Doi et al. | 343/722 |
| 3,725,940 | 4/1973 | Siple | 343/713 |
| 3,902,177 | 8/1975 | Mori et al. | 343/741 |

FOREIGN PATENT DOCUMENTS

| | | | |
|---|---|---|---|
| 0124441 | 4/1983 | European Pat. Off. | H01Q 5/00 |
| 0370746 | 5/1990 | European Pat. Off. . | |
| 2221096 | 1/1990 | United Kingdom | H01Q 7/00 |

OTHER PUBLICATIONS

"CD By Radio Digital Audio Broadcasting", by H. Price, IEEE Review, Apr. 1992, pp. 131–135.

*Primary Examiner*—Michael C. Wimer
*Attorney, Agent, or Firm*—Robert J. Kraus

[57] ABSTRACT

A loop antenna (10) is provided with feed means (12,14) and a variable capacitor (C1) to adjust a first resonant frequency of the antenna (10). A reactive network (C2,L2,X) is included which permits the antenna to provide a further resonant frequency. The reactive network comprises a series-resonant circuit (L2,C2) in parallel with a further reactive element (X). The resonant frequency of the series-resonant circuit is arranged to be substantially equal to the first resonant frequency of the antenna as tuned by the capacitor (C1). The reactance (X) thus has no effect at this frequency. Another resonant frequency for the antenna may be adjusted by altering the reactance (X). The arrangement may be extended to provide further resonant frequencies.

11 Claims, 2 Drawing Sheets

LOOP ANTENNA WITH SERIES RESONANT CIRCUIT AND PARALLEL REACTANCE PROVIDING DUAL RESONANT FREQUENCIES

BACKGROUND OF THE INVENTION

The present invention relates to a loop antenna having a plurality of resonant frequencies and which has particular, but not exclusive, application to reception of signals for Digital Audio Broadcasting (DAB).

Loop antennas are known, for example, from "Antennas" by J. D. Kraus published by McGraw-Hill. One such antenna is shown diagrammatically in FIG. 1 of the accompanying drawing. A wire loop 10 is provided with a pair of feed points 12,14 and a series connected variable capacitor 16, The positions of the feed points 12,14 are generally chosen experimentally to provide a balanced feed to the antenna having an appropriate impedance match, for example 100 Ω. The resonant frequency of the antenna can be adjusted by altering the value of the capacitor 16. Such an antenna has a fairly good in-band performance but outside of the resonant band performance is generally poor. Accordingly another antenna is usually required to receive or transmit signals at other frequencies which is expensive.

SUMMARY OF THE INVENTION

It is an object of the present invention to provide a loop antenna having satisfactory performance at more than one particular resonant band.

According to the present invention there is provided a loop antenna comprising a loop, feed means and a reactive network for tuning the antenna to provide at least two resonant frequencies, the reactive network including a series-resonant circuit having substantially zero reactance at a first resonant frequency of the antenna and a reactive element in parallel with the series-resonant circuit.

By including a reactive network rather than a single capacitor in series with the loop of the antenna, a range of different resonant frequencies may be realised, thus considerably improving the versatility of a loop antenna. One application of such an antenna will be in the reception of Digital Audio Broadcasting, or DAB, where a signal will be transmitted on a number of carriers in a number of different frequency bands. Also, since the frequency bands used for DAB will differ throughout Europe due to prior spectrum commitments, an antenna in accordance with the present invention may be used in conjunction with a multiple-band receiver to provide a single receiver for use over the whole European continent. DAB is discussed briefly in "CD by Radio, Digital Audio Broadcasting", IEE Review, April, 1992, pages 131 to 135.

One way of providing a reactive network suitable for a multiple-resonant frequency loop antenna is to arrange a series-resonant inductor and capacitor (LC) circuit in series with a first tuning capacitor together with a second tuning capacitor or inductor in parallel with the LC circuit. The reactive network may be arranged in the loop itself. For a certain implementation, as will be discussed below, it is desirable to locate the reactive network as far as possible from the feed means. At the resonant frequency of the LC circuit its impedance is zero and the second tuning capacitor or inductor is shorted out. The second tuning capacitor or inductor thus has no effect at that frequency and the antenna is tuned by the first tuning capacitor alone. The second tuning capacitor or inductor determines (in conjunction with the remainder of the network) another resonant frequency of the antenna. If a capacitor is used, the frequency will be higher, if an inductor is used the frequency will be lower. A further such series-resonant LC circuit can be provided in series with the second tuning capacitor to allow a further tuning capacitor or inductor in parallel with the further LC circuit to tune the antenna to a further resonant frequency. This process may be repeated to provide still further resonant frequencies.

An antenna in accordance with the invention preferably has only one feed to facilitate connection to a transceiver.

For particular applications an antenna according to the present invention may be printed onto an insulated substrate in the manner of printed circuit preparation. Such antennas may be manufactured cheaply and could be tuned to appropriate resonant frequencies by trimming of the printed components, for example by using a laser.

For automotive applications particularly, an antenna in accordance with the present invention may be formed on or within a sheet of glass and may even be printed onto a face of a piece of glass to which a further piece of glass will be laminated.

An antenna in accordance with the invention may be operated with more than one receiver and/or transmitter and for such operation a diplexer or multiplexer may conveniently be included in the antenna to route the signals as appropriate.

The present invention also provides a multifrequency antenna, characterised by a phase shifting means coupled between the loop and the feed means, which phase shifting means comprises means for connection to a ground plane and is arranged to provide a balanced coupling to the loop and an unbalanced coupling between the loop and the means for connection to a ground plane. The loop antenna may thus be operated as a monopole with respect to a ground plane to provide a further range of frequencies over which the antenna can operate.

BRIEF DESCRIPTION OF THE DRAWING

The present invention will now be described, by way of example, with reference to FIGS. 2, 3, 4 and 5 of the accompanying drawing, wherein.

DESCRIPTION OF THE PREFERRED EMBODIMENTS

Figure 1:
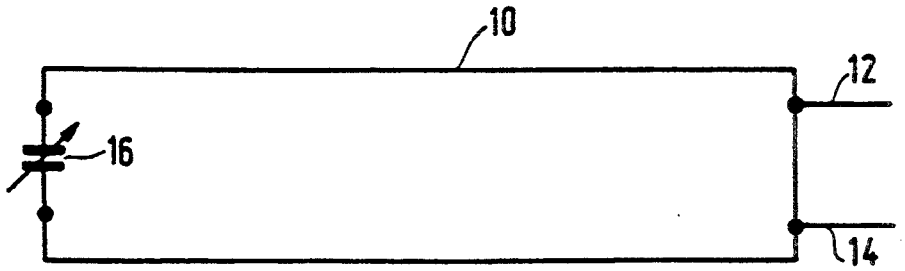
FIG. 1 PRIOR ART
FIG. 1 is a schematic diagram of a prior art loop antenna.
Figure 2:
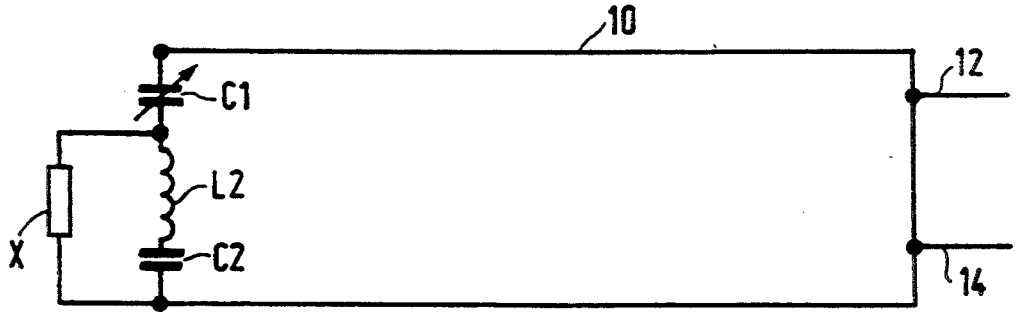
FIG. 2 is a schematic diagram of a loop antenna including a reactive network for providing dual-resonant frequency operation.

The network shown connected to the antenna 10 in FIG. 2 is used to replace the capacitor 16 in FIG. 1 to provide a dual-resonant frequency antenna. A series LC circuit comprised of capacitor C2 and inductor L2 is connected in series with capacitor C1 and a reactance X is connected in parallel with the series LC circuit. A first resonant frequency f1 of the antenna is determined in known manner from the dimensions of the loop 10 and the capacitor C1. The series LC circuit is then arranged to resonate at this frequency by selection of L2 and C2 as given by the equation:

$$f1 = 1/2\pi\sqrt{L2\ C2}$$

At frequency f1 inductor L2 and capacitor C2 exhibit a very low impedance which effectively provides a short circuit and thus the reactance X has no effect on antenna operation. Capacitor C1 may be adjusted in a known manner to tune the first resonant frequency of the antenna, for example by using a screw-operated trimmer or by trimming a component printed into an insulating substrate. At frequencies other than f1 the reactance of the series LC circuit is non-zero and another resonant frequency f2 for the antenna may be tuned by adjusting the reactance X while C1 is left unaltered. At its simplest the reactance X may comprise a variable capacitor or variable inductor. If a variable capacitor is used the frequency f2 will be higher than the frequency f1. If a variable inductor is used the frequency f2 will be lower than f1. In some applications it may be possible to omit C1, for example where the antenna can be manufactured to high tolerances and no tuning is required.

An antenna in accordance with the present invention has been constructed as follows. The length of loop is approximately 25 cm. and the width is approximately 10 cm. C1 is a variable component of 1.2 to 3.5 pF and is adjusted to provide a basic resonant frequency f1 of 180 MHz. C2 is a fixed value component of 12 pF and L2 is a fixed value component of 0.065 $\mu$H. The series resonant frequency of C2 and L2 is therefore close to 180 MHz. X is a variable capacitor of 2.0 to 18 pF and adjustment of this component provides the antenna with a second resonant frequency f2 which may be varied in value between approximately 200 MHz and over 300 MHz. Alteration of the second resonant frequency f2 in this manner has no noticeable effect on the value of f1.

Figure 3:
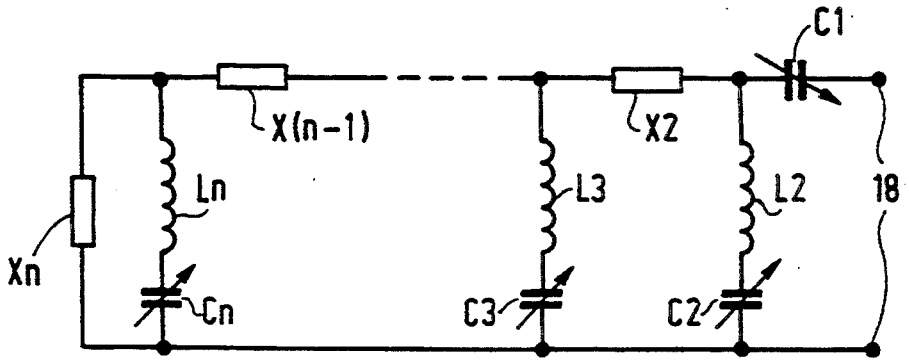
FIG. 3 is a schematic diagram of a reactive network for providing a multiple-resonant frequency loop antenna.

FIG. 3 shows a schematic diagram of a network used between the terminals 18 to replace the capacitor 16 in FIG. 1 to provide a multiple-resonant frequency antenna. Capacitors C1,C2 and an inductor L2 are provided as described previously with reference to FIG. 2 but a reactance X2 is provided in series with a series LC circuit comprised of L3,C3 in place of the reactance X. A single further reactance X3 is provided in parallel with L3,C3 and an antenna comprising such an arrangement would exhibit three resonant frequencies. However, as shown in broken lines on the figure, further reactances X(n−1) and series resonant circuits Ln,Cn may be included in parallel with the previous resonant circuit to provide an antenna with further resonant frequencies. The final reactance Xn is connected in parallel with the final series-resonant circuit Ln,Cn.

At the resonant frequency of each series LC circuit, that circuit has an impedance of zero and accordingly the network to its left in the figure is effectively shorted out and can be ignored. Further resonant frequencies are thus provided in the same manner as the second resonant frequency provided by the network shown in FIG. 2. The resonant frequency fn of the nth series-resonant circuit is given by:

$$fn = 1/2\pi\sqrt{L(n+1) \times C(n+1)}$$

Again, the reactances Xn may comprise variable capacitors or variable inductors.

One possible design procedure is as follows. Dimension the loop (with capacitor C1 if required) to provide the basic resonant frequency f1 of the antenna. Determine L2 to be as large as physically feasible within the constraints of space. From L2 and f1, determine C2 using the equation above. With C1, L2 and C2 in place, X2 may be applied in parallel with L2 and C2 and adjusted to provide the desired frequency f2. Determine L3 to be as large as possible within space constraints and calculate C3 using f2 in the equation above. Now locate X2, L3 and C3 as shown in FIG. 3 and apply X3 in parallel with L3 and C3. X3 may be adjusted to provide f3 and the process continued to provide further resonant frequencies.

Figure 4:
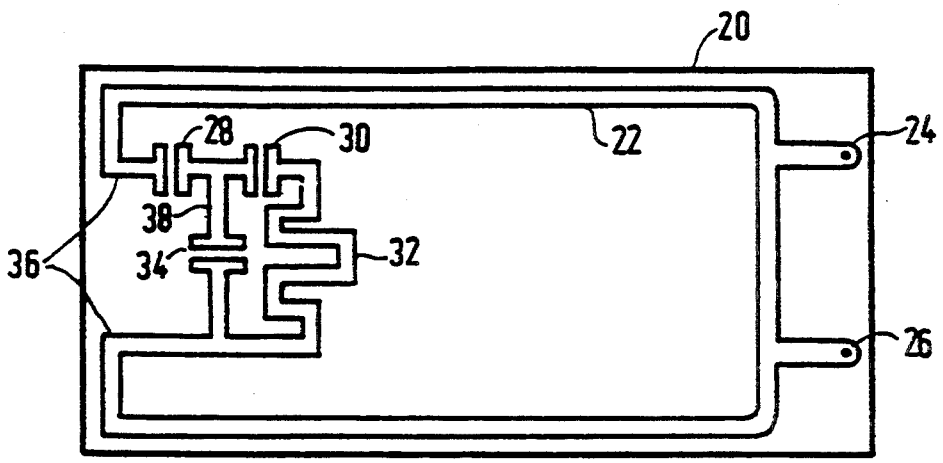
FIG. 4 is a plan view of a printed antenna in accordance with the present invention.

FIG. 4 shows a dielectric substrate 20 with a loop 22, two feed taps 24,26 on the loop and a number of tuning components 28,30,32,34 comprised of copper plating disposed on a surface of the substrate. The loop 22 is broken at one point 36 and one end of the loop is connected to a first terminal of a capacitor 28 having a second terminal which is connected to a first terminal of capacitors 30,34 respectively. A second terminal of the capacitor 30 is connected to a first terminal of an inductor 32. A second terminal of the inductor 32 is connected to a second terminal of the capacitor 34 and to the continuation of this loop 22. The arrangement shown in the figure may be constructed using known techniques such as printing or etching. The arrangement provides a circuit equivalent to that shown in FIG. 2 and may be provided on, or laminated into, glass for use as a windscreen in a car for example.

Where more, or larger components are required it may be advantageous to use an insulating substrate with plating on both sides to accommodate the components. For instance the metallisation 38 shown in FIG. 4 could be arranged on the reverse side of the board to provide the second terminal of capacitor 28 and the first terminals of capacitors 30,34. The plates of each of the capacitors would be arranged aligned in a plane perpendicular to the board in known manner to provide larger values of capacitance than in a single sided construction.

Figure 5:
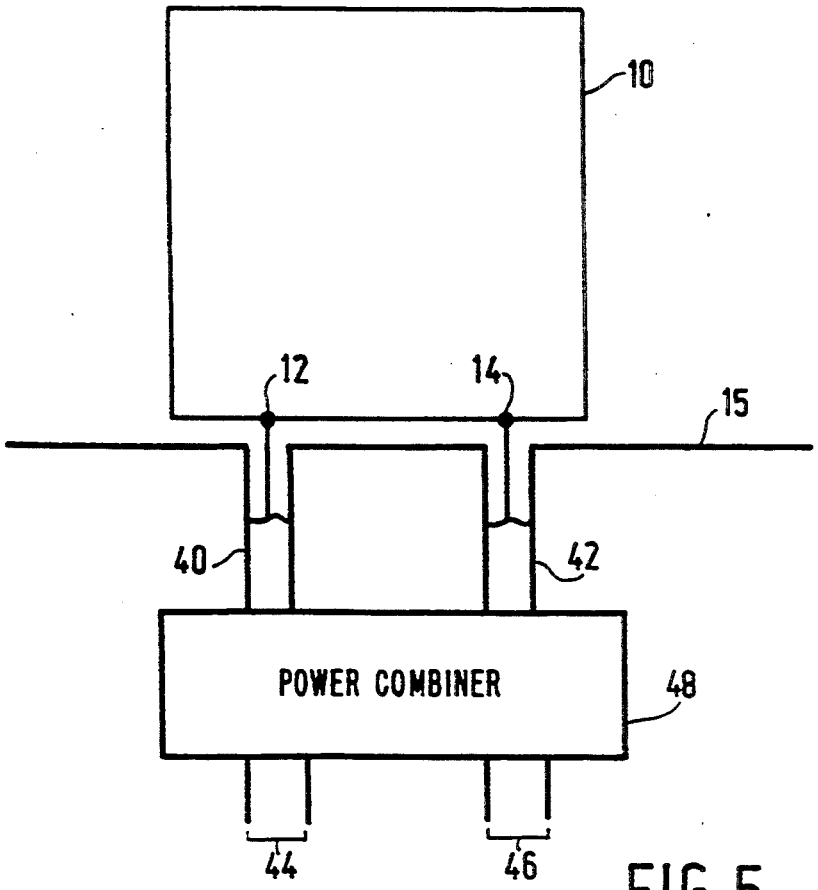
FIG. 5 is a schematic diagram of a loop antenna and a power combiner.

FIG. 5 shows a multifrequency loop antenna 10 having two balanced feed points 12,14 mounted above a metal surface 15 such as a car roof. Where the loop antenna is to be mounted above a non-metallic surface, for example a fibre glass car roof, a metallised plating may be applied to the surface to provide the ground plane.

The size of the ground plane required depends upon the frequency response required of the loop when operating as a short monopole. For receiving signals of a few MHz, a ground plane whose size is of the same order of the loop should be satisfactory. For higher frequency signals a larger ground plane is desirable. While the antenna should be mounted reasonably close to the ground plane the distance is not critical. The feed points of the antenna are connected to a power combiner 48 by two sections of co-axial cable 40,42. The outer or shield conductors of the cables 40,42 are connected to the metal surface while the inner conductors are connected to the feed points 12,14 respectively. The power combiner 48 has two ports 44,46 which are coupled to the antenna with phase differences of 0° and 180° respectively, in other words in-phase and in antiphase.

In operation, the port 46 permits the antenna to be used as a multifrequency loop antenna with a balanced feed. The port 44 permits the antenna to be operated as a monopole over the ground plane 15. With the two feed points 12,14 of the loop being fed in-phase, the loop behaves like a solid piece of conducting material. Each of the ports 44,46 of the power combiner may be connected to radio receivers and/or transmitters as appropriate. Where two or more such devices need to be connected to one of the ports, a diplexer or multiplexer may be required. For automotive radio applications a rectangular loop approximately 25 cm long is suitable. To provide multi-directional performance the loop is disposed at an angle (other than a right angle) to the ground plane but the angle is not critical.

Where the multifrequency loop antenna is used as a monopole at a frequency at which the reactive network has a high impedance it is desirable to locate the reactive network distant from the feed to the loop so that destructive cancelling of signals in the larger part of the antenna on one side of the reactive network is avoided.

From reading the present disclosure, other modifications will be apparent to persons skilled in the art. Such modifications may involve other features which are already known in the design, manufacture and use of loop antennas and component parts thereof and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

I claim:

1. A loop antenna apparatus comprising a loop of conductive material, feed means coupled to the loop, and a reactive network electrically connected in series with the loop for tuning the loop to at least first and second resonant frequencies, said reactive network including:

a. a series resonant circuit having substantially zero reactance at the first resonant frequency; and b. reactive means electrically connected in parallel with the series resonant circuit for cooperating with said circuit to tune the loop to at least the second resonant frequency.

2. A loop antenna apparatus as in claim 1 where the reactive means comprises a single reactive element.

3. A loop antenna apparatus as in claim 2 where the reactive element comprises a capacitor.

4. A loop antenna apparatus as in claim 1 where the reactive means comprises a plurality of reactive circuits for respectively effecting tuning of the loop to a plurality of different frequencies.

5. A loop antenna apparatus as in claim 1, 2 or 3 where the reactive network and the loop comprise respective conductors disposed on a common substrate.

6. A loop antenna apparatus as in claim 5 where the reactive network is disposed at a location remote from where the feed means is coupled to the loop.

7. A loop antenna apparatus as in claim 5 where the substrate comprises a window.

8. A loop antenna apparatus as in claim 1, 2 or 3 including a phase shifting means through which the feed means is coupled to the loop.

9. A loop antenna apparatus as in claim 8 where the phase shifting means comprises means for electrical connection to a ground plane and is arranged to provide a balanced coupling to the loop and an unbalanced coupling between the loop and the means for electrical connection to the ground plane.

10. A loop antenna apparatus as in claim 8 including a ground plane electrically connected to the phase shifting means, said ground plane comprising a conductive surface incorporated in a vehicle.

11. A loop antenna apparatus as in claim 8 where the phase shifting means comprises a power combiner.

* * * * *